US005526793A

United States Patent [19]

Johansson

[11] Patent Number: 5,526,793

[45] Date of Patent: Jun. 18, 1996

[54] PROCESS FOR THE INDICATION OF ABNORMALITIES IN VEHICLES DRIVEN BY INTERNAL COMBUSTION ENGINES

[75] Inventor: Anders Johansson, Enhörna, Sweden

[73] Assignee: Saab Automobile Aktiebolag, Sweden

[21] Appl. No.: 436,238

[22] PCT Filed: Nov. 17, 1993

[86] PCT No.: PCT/SE93/00983

§ 371 Date: May 17, 1995

§ 102(e) Date: May 17, 1995

[87] PCT Pub. No.: WO94/11627

PCT Pub. Date: May 26, 1994

[30] Foreign Application Priority Data

Nov. 18, 1992 [SE] Sweden ..... 9203452

[51] Int. Cl.[6] ..... F02D 17/04; F02B 77/08

[52] U.S. Cl. ..... 123/481; 123/198 D; 123/688

[58] Field of Search ..... 123/198 D, 198 DB, 123/198 F, 479, 481, 688

[56] References Cited

U.S. PATENT DOCUMENTS 4,124,013 11/1978 Rivalto ..... 123/198 DB
4,172,434 10/1979 Coles ..... 123/481
4,459,951 7/1984 Tobinaga et al. ..... 123/198 DC
4,562,801 1/1986 Koike ..... 123/196 S
4,899,706 2/1990 Sasaki ..... 123/198 D
4,960,087 10/1990 Junginger et al. ..... 123/339.15
4,960,088 10/1990 Havemann et al. ..... 123/198 D
4,966,115 10/1990 Ito et al. ..... 123/418
5,060,608 10/1991 Umemoto ..... 123/198 D

*Primary Examiner*—Tony M. Argenbright
*Attorney, Agent, or Firm*—Ostrolenk, Faber, Gerb & Soffen

[57] ABSTRACT

A process for indicating abnormal conditions in a motor vehicle by inducing misfires through the absence of fuel supply. The fuel supply is interrupted cylinder by cylinder in such a manner that the supply is interrupted during a proportion of the total number of injection cycles of the respective cylinders during a first fuel supply sequence, after which the next cylinder interrupts the fuel supply for a proportion of the total number of injection cycles of that cylinder during a subsequent fuel supply sequence. The interruptions of the fuel supply take place preferably as a predetermined number of injection cycles during a fuel supply sequence, and when each injection supply sequence is of equal length or includes a certain number of injection cycles. This can give rise to a distinct signal quality from the engine, in the form of irregular, uncomfortable engine running, while each individual cylinder is subjected to the least possible disturbance, apart from an ideal operating condition. High cylinder temperature can be maintained for complete combustion and a low proportion of uncombusted fuel reaches the catalytic converter, which reduces the emissions from the engine.

12 Claims, 1 Drawing Sheet

PROCESS FOR THE INDICATION OF ABNORMALITIES IN VEHICLES DRIVEN BY INTERNAL COMBUSTION ENGINES

BACKGROUND OF THE INVENTION

This invention relates to a process for indicating abnormalities in vehicles driven by internal combustion engines.

Different types of systems are known in which the inducement of irregular engine running is used as an alarm signal to alert the driver that the engine is or soon will be in a critical condition.

In U.S. Pat. No. 4,459,951, for example, a system is shown in which the ignition system is actuated in such a manner that the ignition spark generation is interrupted increasingly as the engine temperature is exceeded, so that the engine gradually decelerates. In U.S. Pat. No. 4,562,801 the ignition system is actuated on the basis of the lubricating oil level, and in U.S. Pat. No. 4,966,115 the ignition system is actuated in such a manner that when an abnormal condition has been detected a specific ignition setting curve is selected.

In U.S. Pat. No. 5,060,608 the ignition system is also actuated in such a manner that induced misfiring is proportional to the degree of the abnormal condition. In U.S. Pat. No. 4,899,706, U.S. Pat. No. 4,124,013 and U.S. Pat. No. 4,960,088 different systems are shown in which the engine is switched off when the fuel level drops below a predetermined level.

SUMMARY OF THE INVENTION

The objective of the invention is to provide the driver of a motor vehicle with a clear indication that an impermissible operating condition has been reached, or that the engine is approaching a critical operating condition. The indication is given in the form of irregular engine running, which must be effected so that the engine gives off the minimum quantity of emissions.

Another objective is to induce the irregular engine running so that the quantity of uncombusted fuel which is capable of reaching the catalytic converter is reduced. With alarm systems of prior art which actuate the engine ignition system there is a risk that the catalytic converter will be reached by such fuel.

Since all incomplete combustion in the engine gives rise to cooling of the cylinders in question, a further objective of the invention is to ensure that the irregular engine running is such that every cylinder in the internal combustion engine receives the minimum of cooling, causing the highest possible temperature to prevail in the combustion chamber for subsequent combustion, which favours complete combustion.

One further objective is to allow operation for a certain time on a reserve tank or a minimum remaining amount of fuel, where there is at the same time a clear indication, in the form of irregular engine running, to enable the driver to drive the vehicle to a more suitable place for parking or, if possible, to reach a filling station.

Other objectives include being able to indicate several other abnormal conditions of the internal combustion engine, its exhaust system, and possibly the vehicle in general by exerting a palpable influence on the engine. Such conditions may be excessive engine temperature, too low an oil level or too high an oil temperature, too little coolant, loss of or reduced function of critical emission reducing components, or loss of or reduced function of other vehicle systems, such as the braking system or other safety systems.

In accordance with the present invention, a process for indicating abnormalities in the operation of vehicles driven by internal combustion engines may include detecting a plurality of engine and vehicle parameters; determining from one of the detected parameters whether an abnormal condition exists; and, if an abnormal condition exists, interrupting the supply of fuel from the fuel control system to one or more of the cylinders for a proportion of one or more injection cycles of a fuel supply sequence in such a manner as to cause irregular engine running so that a vehicle driver receives an indication of an abnormal condition through such irregular engine running.

The invention is applied advantageously in connection with fuel systems which are intended to be operated with different fuel qualities, such as methanol and petrol. So-called slave tanks may be used in these mixed fuel systems, as shown in WO 91/04406, where the slave tank is used to retain a volume of a specific fuel quality next to the engine, which volume does not alter in content when the main fuel tank is filled. The slave tank therefore enables the engine to start on the same quality of fuel as before the engine was switched off, and the fuel mixture newly obtained after filling will be slowly mixed out in the: slave tank. This enables the lambda sensor of the engine to be used for adjusting to the new fuel, despite the fact that the lambda sensor does not begin to operate for one or two minutes after starting. However, the slave tank gives both the engine and the lambda sensor time to reach the correct operating temperature before :they are slowly adapted to the fuel quality newly obtained by filling. One problem here, however, is that the engine should never be run long enough for the slave tank also to be completely drained since it may be difficult to obtain exactly the same fuel quality as that which was originally in the main fuel tank. However, the slave tank has advantageously such a large volume that it is unnecessary to switch off the engine completely when the main fuel tank is empty. Instead it is better to indicate clearly that the slave tank is beginning to empty so that the driver is given the opportunity to reach a filling station. For this purpose the process according to the invention is used to indicate that the slave tank is being emptied.

Other features and advantages of the present invention will become apparent from the following description of the invention which refers to the accompanying drawings.

DETAILED DESCRIPTION OF THE PREFERRED EMBODIMENT(S)

Figure 1:
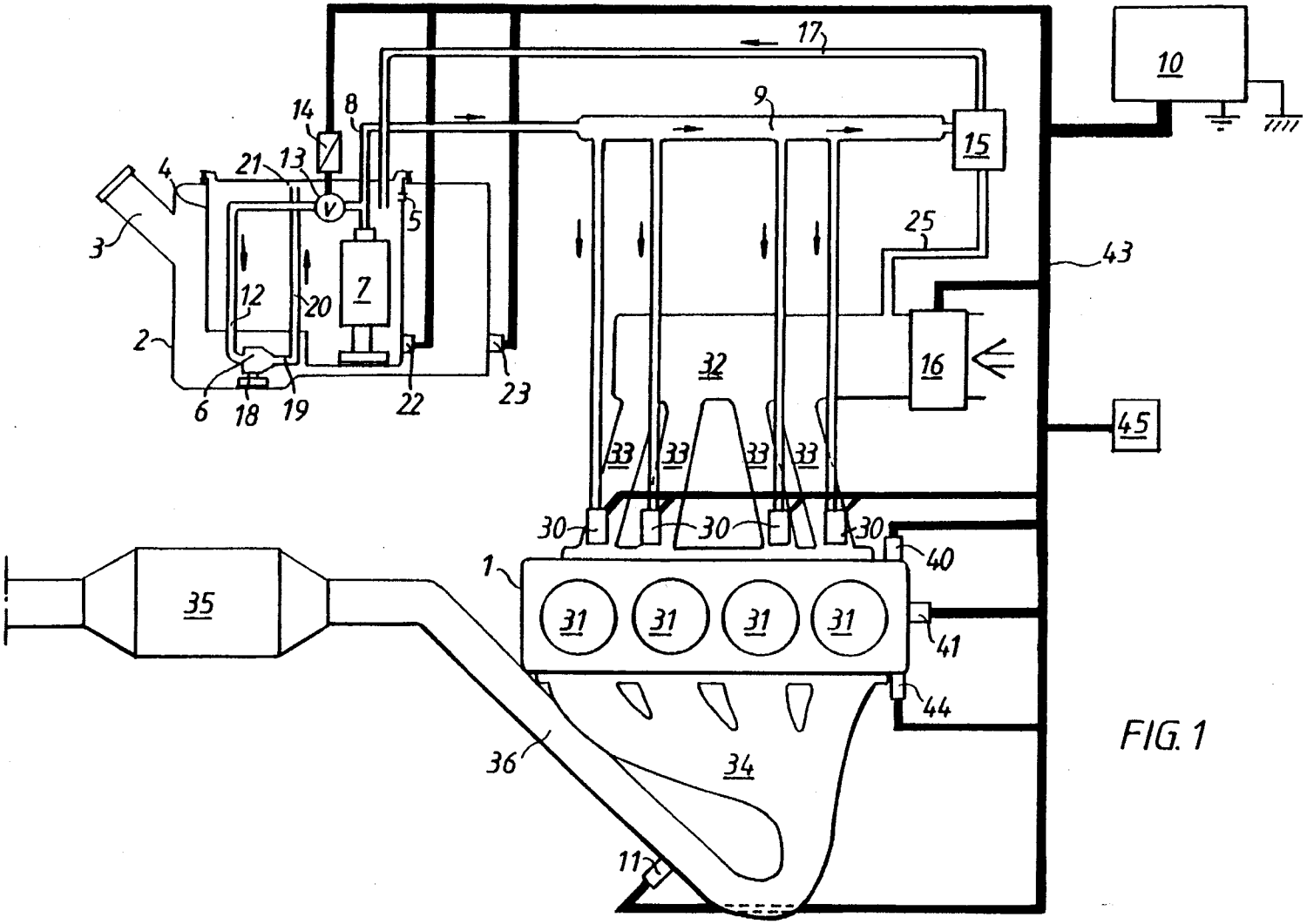
FIG. 1 shows an arrangement to which the process according to the invention can be applied.

In the case of a four-cylinder Otto engine, for example, the cylinders fire in a predetermined sequence, e.g. 1-3-4-2, i.e. cylinder 1 fires first, and when the crankshaft has rotated 180 degrees cylinder 3 fires, after which cylinders 4 and 2 fire at intervals of 180 crankshaft degrees. In this case the engine rotates two revolutions before cylinder 1 reaches the firing position again.

Distinct, irregular engine running is obtained when a sufficient number of misfires occur. Even at a misfire level as low as a few per cent, between 2–10%, but preferably 5%, a clearly perceptible misfiring process is obtained. If the misfires are at a level of 5%, the irregular running is propagated throughout the vehicle, giving rise to jerky, uncomfortable vehicle performance.

Even if the misfiring is caused by fuel injection set cylinder by cylinder, a certain limited quantity of fuel can still be drawn into the cylinder as a result of indirect injection. This fuel may derive from a previous ignition cycle in the form of drops of fuel on walls of the intake system, or from injections to other cylinders by overflow into the intake system. However, this limited quantity of fuel gives rise to a sufficiently lean fuel-air mixture to prevent ignition and the fuel-air mixture is then flushed out into the exhaust system.

With a predetermined maximum level of misfires, a catalytic converter incorporated in the exhaust system can withstand this limited fuel lead without being destroyed. Conventional catalytic converters are able to withstand a limited misfire level, and if the misfire level is around 5%, the life of the catalytic converter is not affected to any great degree.

By selectively controlling such irregular engine running up to this predetermined level by regularly recurring interruptions of the fuel supply, an engine disturbance which can be detected directly by the driver is indicated in the form of a signal serving to indicate to the driver that there is an abnormal condition.

By controlling the engine disturbance intelligently so that only one cylinder at a time has interrupted fuel supply, i.e. is fully out of operation, on only one, or a few consecutive injection cycles, followed by a number of uninfluenced injection cycles, before the next cylinder is subjected to one or a few consecutively, essentially completely absent injection cycles, the distinct signal character can be maintained whilst the emissions are limited to a minimum. By controlling the fuel interruptions so that the misfires remain at a predetermined level, a well-balanced compromise is achieved between a distinct signal character and low emissions, without risking shortening the life of the catalytic converter.

The cylinder (firing) sequence of a four-cylinder Otto engine is described below as an example of how the engine disturbance should be interpreted. Every row constitutes a firing sequence in which all the cylinders, 1–4, have received an injection of fuel in the respective injection cycles, and one subsequent firing, and the engine has therefore rotated 2 revolutions. A, B, C and D relate to different sequences of the fuel supply. The engine disturbance shown can be obtained with a fuel system with cylinder injectors and with injection synchronised to the compression stroke of the engine.

1 - 3 - 4 - 2 |
1 - 3 - 4 - 2 |
1 - 3 - 4 - 2 Sequence A
1 - 3 - 4 - 2 |
1 - 3 - 4 - 2 | _____
1 - 3 - 4 - 2 |
1 - 3 - 4 - 2 |
1 - 3 - 4 - 2 Sequence B
1 - 3 - 4 - 2 |
1 - 3 - 4 - 2 | _____
1 - 3 - 4 - 2 |
1 - 3 - 4 - 2 |
1 - 3 - 4 - 2 Sequence C
1 - 3 - 4 - 2 |
1 - 3 - 4 - 2 | _____

-continued

1 - 3 - 4 - 2 |
1 - 3 - 4 - 2 |
1 - 3 - 4 - 2 Sequence D
1 - 3 - 4 - 2 |
1 - 3 - 4 - 2 | _____

As indicated by the underlined cylinder number, cylinder 1 receives the first interrupted fuel supply during an injection cycle in a first injection sequence, sequence A, after which the fuel supply to cylinders 3, 4 and 2 is interrupted, with a number of intervening uninfluenced fuel injections in the sequences B-D. The effect will be that the engine receives a 5% misfire level, but one in which each cylinder is only subjected to a quarter of this misfire level, i.e. 1.25%. At such a 5% misfire level a distinct signal quality is obtained in the form of irregular engine running. This misfire level can be arranged continuously, i.e. each individual cylinder is subjected to misfiring every 20 firing positions, but the engine is subjected to misfiring every 5 firing positions when an abnormal condition prevails.

Alternatively this predetermined misfire level can be activated for a certain number of seconds, which would then result in a number of misfires proportional to the engine speed, followed by a certain period when the engine is not subject to misfires caused by lack of fuel injection. The latter signal sequence may have a relatively short misfire interval, suitably within the interval of 2–5 seconds, followed by a much longer period of undisturbed engine running for 10–30 seconds, possibly longer.

In order to improve the signal quality, if possible, a very limited number of injection cycles may be omitted in succession for each cylinder, because a certain amount of fuel may remain in the intake manifold of the respective cylinders, thereby giving rise to a certain degree of combustion in the next firing position, which would not produce such a palpable effect in the form of irregular engine running. Such a cylinder sequence is set out below, where the fuel supply is interrupted to two consecutive compression cycles for the misfiring cylinder. A, B, C and D relate to different sequences of the fuel supply.

1 - 3 - 4 - 2 |
1 - 3 - 4 - 2 |
1 - 3 - 4 - 2 |
1 - 3 - 4 - 2 Sequence A
1 - 3 - 4 - 2
1 - 3 - 4 - 2 | _____
1 - 3 - 4 - 2 |
1 - 3 - 4 - 2 |
1 - 3 - 4 - 2 |
1 - 3 - 4 - 2 Sequence B
1 - 3 - 4 - 2 |
1 - 3 - 4 - 2 | _____
1 - 3 - 4 - 2 |
1 - 3 - 4 - 2 |
1 - 3 - 4 - 2
1 - 3 - 4 - 2 Sequence C
1 - 3 - 4 - 2 |
1 - 3 - 4 - 2 | _____
1 - 3 - 4 - 2 |
1 - 3 - 4 - 2 |
1 - 3 - 4 - 2 |
1 - 3 - 4 - 2 Sequence D
1 - 3 - 4 - 2 |
1 - 3 - 4 - 2 | _____

As indicated by the underlined cylinder number, cylinder 1 receives an interrupted fuel supply for two consecutive injection cycles, during injection sequence A. The fuel supply is then interrupted for two consecutive injection cycles to cylinders 3, 4 and 2, with a number of intervening uninfluenced fuel injections in injection sequences B-D. The effect will be for the engine to attain a misfire level slightly exceeding 5%, but one at which each cylinder is only subjected to a quarter of this misfire level. Such a misfire level guarantees that a distinct signal quality will be obtained in the form of irregular engine running.

The fuel injection may possibly be interrupted for more than two consecutive injection cycles, but this increases cylinder cooling, which can be disadvantageous. Around ten consecutive injection interruptions for the cylinder in question would probably be an appropriate maximum value, since an internal combustion engine of the Otto type, particularly at high speeds around 6000 rpm, has time for 50 firings/injection cycles per cylinder, and an interruption for some ten injection cycles is not sufficient to cool the cylinder.

The process has the advantage that the combustion chamber for the respective cylinders is subject to the minimum of :disturbances, which is advantageous in terms of maintaining a temperature favouring complete combustion. Similarly, the supply of uncombusted fuel to the catalytic converter is minimised, thereby extending the life of the catalytic converter.

As a final safety measure, an automatic :engine stopping device may possibly be activated if the irregular engine running has been activated for a predetermined time or distance, or if the indication level of the abnormal condition detected by the monitoring system exceeds an even higher level than the lower level which initially activates the misfiring process.

The abnormality indication, in the form Of irregular engine running, of signal quality, gives an extremely clear signal to the driver, enabling him to be more aware of the fact that a fault has arisen, and causes him to study other information equipment in the vehicle more closely. Where a main tank in a fuel system for methanol-petrol operation is empty, this is also indicated by lighting a signal lamp on the instrument panel. In cases where the abnormality is due to high engine temperature or low oil level, this is also indicated by an indicating instrument deflection or a signal lamp which lights up on the instrument panel. The irregular engine running can then be traced more easily to the correct source of error. Where only visual instruments are used to indicate an abnormality, a considerable time may elapse before the driver actually notices that something is wrong.

An arrangement is described in the following to which the process according to the invention is applicable.

FIG. 1 shows an arrangement for fuel supply to an internal combustion engine 1. A main tank 2 can be filled with fuel via a filler opening 3. A slave tank 4, which is suitably designed to hold a couple of liters, is arranged inside main tank 4. The slave tank is connected to the main tank only by an overflow outlet 5, and indirectly via an ejector 6 arranged at the bottom of main tank 2. Overflow outlet 5 is positioned at such a level that it is above the highest level which can be reached when the main tank is filled. For filling purposes the pump nozzles are provided with an automatic shutoff when the fuel reaches the nozzle, which is why the tank cannot and should not be filled with fuel to the edge of filler opening 3. The overflow outlet could otherwise be arranged at a level lying above the edge of the filler opening. Ejector 6 is driven by pressurised fuel from fuel pump 7 arranged in the slave tank. Fuel pump 7 sucks fuel from the bottom of the slave tank, thus pressurised fuel is fed via a feed line 8 to a fuel manifold 9.

Manifold 9 distributes the fuel to injectors 30, which are arranged by a method of prior art to supply the fuel cylinder by cylinder, either directly into the cylinder, or, more conventionally, indirectly via the inlet ports 33 of the respective cylinders. A sequential injection is preferably applied, the rate and injection time of which are controlled by a control unit 10, according to the operating condition of the engine. A fuel pressure governor 15, which maintains the pressure in fuel manifold 9, and feeds fuel in return pipe 17 back to slave tank 4, is also arranged on fuel manifold 9. Fuel pressure governor 15 receives control pressure via pipe 25 from intake manifold 32, so that the fuel pressure in manifold 9 is increased as the inlet pressure of the engine increases.

An electronic control unit 10 is connected by a cable network 43 to a number of sensors 11,22, 23, 16, 40, 41, 44 and actuators 14, 30, for controlling engine 1 according to the operating parameters concerned. Input signals am received from a lambda sensor 11, level sensors in the slave tank and main tank, 22 and 23 respectively, an air mass gauge 16, an engine temperature sensor 40, a crankshaft sensor 41 and an oil pressure sensor 44. Control unit 10 can also receive input signals from a firing system 45 for identifying the engine compression stroke. The actuators which are controlled by the output signals from the control unit are injectors 30, arranged on each cylinder, together with valve mechanism 13, 14 for activating ejector 6.

Control unit 10 controls primarily the fuel flow rate in proportion to the amount of air drawn into cylinders 31, which is detected by air mass gauge 16, The control unit also detects the oxygen content of the exhaust gases with a lambda sensor 11, which is arranged in the exhaust system of the internal combustion engine, downstream from an exhaust gas collector 34 and upstream from a catalytic converter 35. As soon as the lambda sensor 11 has reached the operating temperature required for it to act as a detector, control unit 10 receives information on how much the fuel supplied, and controlled primarily according to the amount of air sucked in, is to be corrected to maintain optimum combustion and ensure the most favourable conditions for operation of the catalytic converter. The control unit can also detect, by means of lambda sensor 11, the mixing ratio of methanol to petrol, and on this basis correct the amount of fuel fed to the cylinders so that the correct quantity of the fuel value of the mixture concerned is received. Through different measures, such as positioning closer to the engine or electrical heating, the lambda sensor can be arranged to reach its operating temperature more quickly. Normally, however, it takes between 60–90 seconds for the catalytic converter to reach operating temperature by spontaneous heating.

Feed pipe 12 of ejector 6 is connected to feed line 8 so that a partial flow of the fuel pressurised from the pump is able to reach ejector 6. As the ejector itself acts as a throttle, maintenance of the pressure in flow pipe 8 and fuel manifold 9 is guaranteed. It is also guaranteed that a certain return flow will be maintained in fuel return pipe 17. The flow in ejector feed pipe 12 is actuated by a valve mechanism 13, which prevents the fuel from flowing to the ejector before the lambda sensor of the internal combustion engine has reached the required operating temperature. This can be achieved so that control unit 10 monitors lambda sensor 11, and when the lambda sensor comes into operation, control unit 10 activates a valve 13 which can be actuated by an electromagnet 14, so that the flow is opened. It should, preferably, be possible to actuate the valve so that it opens when the electromagnet is supplied with voltage and closes automatically when there is no electromagnet operating voltage. Ejector feed pipe 12 leads down to an ejector 6 arranged on the bottom of main tank 2. The ejector feed pipe may pass through the bottom of the slave tank via a seal, not shown, or alternatively it may pass out through the wall of the slave tank above the level of overflow outlet 5. The ejector should preferably be of a type such as that shown in detail in EP,B,305350 or WO 91/17355. Suction side 18 of the ejector is arranged at the bottom of main tank 2, and the flow from feed pipe 12 entrains fuel from the main tank to outlet 19 of the ejector. Outlet 19 of the ejector is connected to a rising pipe 20, which may pass through the bottom of the slave tank via a seal, not shown, or alternatively pass in through the wall of the slave tank above the level of overflow outlet 5. Rising pipe 21 discharges above overflow outlet 5 in slave tank 4, and this overflow outlet 5 is located higher than the highest level to which the fuel can be filled in main tank 2 via filler opening 3.

When the control unit detects that lambda sensor 11 has reached the required operating temperature, mechanism 13, which actuates the flow in ejector feed pipe 12, is actuated so that the fuel begins to flow. The fuel from main tank 2 then begins to be drawn into slave tank 4, so that it is kept filled. With a sufficiently high capacity of fuel pump 7 slave tank will be kept continuously filled and will be flushed through by the fuel from main tank 2, whilst excess mixed fuel in the slave tank flows back to the main tank via overflow outlet 5. This enables the slave tank to pass quickly to a largely similar mixing ratio to that of the mixture present in the main tank, which transition takes place whilst the lambda sensor is in operation, and adaptively adjusts the fuel supply to the variation in mixing ratio in the slave tank.

On the other hand, if control unit 10 detects, via level sensor 23, that main tank 2 is empty, this is an abnormal condition because continued operation causes the fuel left in slave tank 4 to be consumed. If the slave tank is completely drained, this causes starting problems because the control unit is set to the mixing ratio of the fuel now used up and the tank may be filled with a completely different fuel mixture. Similarly, valve 13 does not open until lambda sensor 11 has reached its operating temperature, which does not happen when the slave tanks is completely drained and the engine consequently receives no fuel, despite the tank being filled. The fact that the main tank is empty, or is starting to empty, in the systems described above, constitutes an abnormal condition which is suitably indicated by the process according to the invention.

Similarly, control unit 10 can apply the process according to the invention if the engine temperature becomes too high, which is indicated by sensor 40, if the oil pressure disappears, which is indicated by sensor 44, or if the lambda sensor 11 gives an incorrect or no signal.

The process according to the invention is not limited to systems with the sensors exemplified in FIG. 1 for detecting abnormal conditions.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. A process for indicating abnormalities in the operation of vehicles driven by internal combustion engines, which vehicles incorporate a fuel control system for controlling the fuel supply, cylinder by cylinder, to the cylinders of the internal combustion engine, which method comprises:

detecting a plurality of engine and vehicle parameters;

determining from one of the detected parameters whether an abnormal condition exists; and if an abnormal condition exists, interrupting the supply of fuel from the fuel control system to one or more of the cylinders for a proportion of one or more injection cycles of a fuel supply sequence in such a manner as to cause irregular engine running so that a vehicle driver receives an indication of an abnormal condition through such irregular engine running.

2. A process according to claim 1, wherein the fuel supply sequence comprises a predetermined number of injection cycles assigned to all the cylinders, and the fuel supply is interrupted by the absence of a predetermined proportion of the injection cycles during such fuel supply sequence.

3. A process according to claim 2, wherein the interrupted supply of fuel takes place sequentially, cylinder by cylinder.

4. A process according to claim 3, wherein the fuel supply is interrupted to only one of the cylinders during some of the total number of injection cycles of this cylinder during the fuel supply sequence.

5. A process according to claim 4, wherein after the fuel supply to the one cylinder has been interrupted during some of the total number of injection cycles of such cylinder during a fuel supply sequence, the supply of fuel to a second cylinder in a next fuel supply sequence is interrupted correspondingly.

6. A process according to claim 5, wherein a predetermined number of injection cycles are absent during a fuel supply sequence, and wherein all of the cylinders receive an interruption before a cylinder with a previously interrupted fuel supply is again subjected to interrupted fuel supply.

7. A process according to claim 6, wherein the interruption of fuel supply takes place to an extent equal to 2–10% of the number of injection cycles during a fuel supply sequence.

8. A process according to claim 6, wherein the interruption of fuel supply takes place to an extent equal to 5% of the number of injection cycles during a fuel supply sequence.

9. A process according to claim 1, wherein an abnormal condition is indicated by a low fuel level in a fuel tank.

10. A process according to claim 1, wherein an abnormal condition is indicated by a low fuel level in a slave fuel tank.

11. A process according to claim 1, wherein an abnormal condition is indicated when an exhaust cleaning system of the vehicle does not operate satisfactorily.

12. A process according to claim 11, wherein an abnormal condition is indicated when there is a risk of engine damage if the internal combustion engine continues to operate.

* * * * *